US006035679A

United States Patent [19]

Meroni

[11] Patent Number: 6,035,679

[45] Date of Patent: Mar. 14, 2000

[54] HINGED LOCK KEY

[75] Inventor: Gersam Meroni, Capriano di Briosco, Italy

[73] Assignee: Serrature Meroni S.p.A., Milan, Italy

[21] Appl. No.: 09/056,759

[22] Filed: Apr. 7, 1998

[51] Int. Cl.[7] ..... E05B 19/02

[52] U.S. Cl. ..... 70/396; 70/408

[58] Field of Search ..... 70/408, 395, 396, 70/456 R

[56] References Cited

U.S. PATENT DOCUMENTS

| | | | |
|---|---|---|---|
| 149,191 | 3/1874 | Brady | 70/396 |
| 5,794,471 | 8/1998 | Rizzo | 70/408 X |

FOREIGN PATENT DOCUMENTS

| | | | |
|---|---|---|---|
| 0187101 A2 | 7/1986 | European Pat. Off. . | |
| 0648589 A1 | 4/1995 | European Pat. Off. . | |
| 624138 | 7/1927 | France | 70/408 |
| 1535150 | 8/1968 | France . | |
| 2098689 | 3/1972 | France . | |
| 2659285 | 2/1978 | Germany | 70/408 |
| 8803909 | 8/1989 | Germany . | |
| 4101461 | 8/1991 | Germany | 70/408 |
| 4203886 A1 | 8/1993 | Germany . | |

*Primary Examiner*—Suzanne Dino Barrett
*Attorney, Agent, or Firm*—Sheridan Ross P.C.

[57] ABSTRACT

A hinged lock key has a bow and a shank from which extend two opposite transverse arms on which the bow is hinged and moves between the working position and folded positions; a snap-fastening connection acting between the bow and the arms keeps the working position stable and enables the folded positions to be reached by overcoming a given force. This key structure is inexpensive to produce.

20 Claims, 2 Drawing Sheets

HINGED LOCK KEY

BACKGROUND OF THE DESCRIPTION

The subject of the present invention is a hinged lock key.

Hinged lock keys, or keys with a bow that folds with respect to the shank, are known. These keys are used in particular when, in the use position, the bow of the key projects from the lock so as to constitute a hazard or such that someone moving or passing close to it may knock into it; a typical example would be keys for locks in desk drawers. If it is knocked, the bow folds back so as to avoid an accident. The bow may also be held in the folded position when the key is inserted in the lock but is not being used, so as to avoid people knocking into it in the first place.

The bow of these keys usually comprises a flat shaped element, made of fairly rigid plastic, which has a C-shaped cavity housing a small block, made of the same plastic, from which the metal shank extends; a pin which is inserted forcibly into the wings of the C-shaped cavity and into the block allows the bow to rotate with respect to the shank and also has the function of securing the shank in the block; projections are formed in the cavity and matching recesses are formed in the block so as to produce a snap-fastening connection that keeps the working position of the bow stable and allows the bow to rotate, in other words to bend, with respect to the shank, simply by overcoming a given force.

This known structure for a hinged key is expensive to produce because it consists of four pieces. Also, during the production process, it is firstly necessary to mould the flat shaped element and the block; then the shank has to be inserted into the block, and then the block/shank assembly into the cavity in the flat element; lastly, the pin needs to be inserted very accurately into appropriate aligned holes made in the flat element and in the block.

SUMMARY OF THE INVENTION

The object of the present invention is to provide a hinged lock key which is cheaper to produce and is at least as effective as known hinged keys.

This object is achieved by means of a hinged lock key comprising a bow and a shank, in which the bow is hinged with respect to the shank and moves between the working position and folded positions, and in which a snap-fastening connection is provided which keeps the working position stable and enables the folded positions to be reached by overcoming a given force, characterized in that two opposite transverse arms, on which the bow is hinged, extend from the shank and in that the snap 15 fastening connection acts between the bow and the arms.

BRIEF DESCRIPTION OF THE DRAWINGS

In order to gain a better understanding of the invention a description is given below of a non-limiting example thereof which is illustrated in the appended drawings, in which.

DETAILED DESCRIPTION OF THE PREFERRED EMBODIMENT

Figure 1:
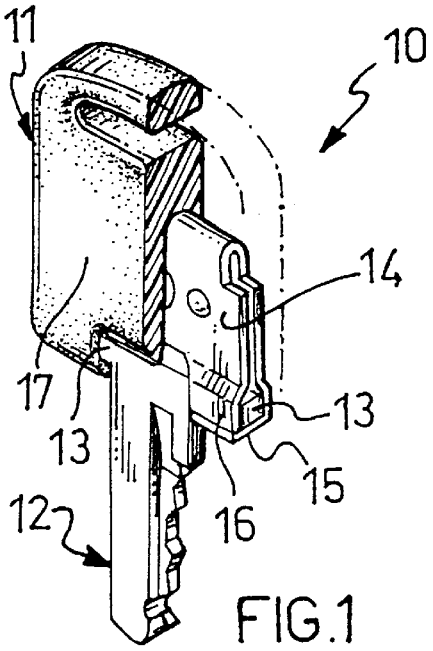
FIG. 1 shows a partially cut-away perspective view of a hinged lock key according to the invention.

The lock key shown in FIG. 1, denoted overall by the reference 10, comprises a bow 11 via which it is gripped and a toothed metal shank 12 designed to be inserted into the lock.

Two opposite transverse arms 13, having a quadrilateral section and formed in one piece with the shank, extend from the shank 12, at the point where it is connected to the bow 11.

Hinged on to the arms 13 is a metal core 14 consisting of a spring formed by a folded piece of sheet steel with shaped ends 15 and 16 that enclose the arms 13 on three sides, following their shape. The metal core 14 is embedded in a soft, suitably shaped, elastic casing 17, for example made of silicone rubber. The casing 17, together with the core 14, forms the bow 11.

Figure 2:
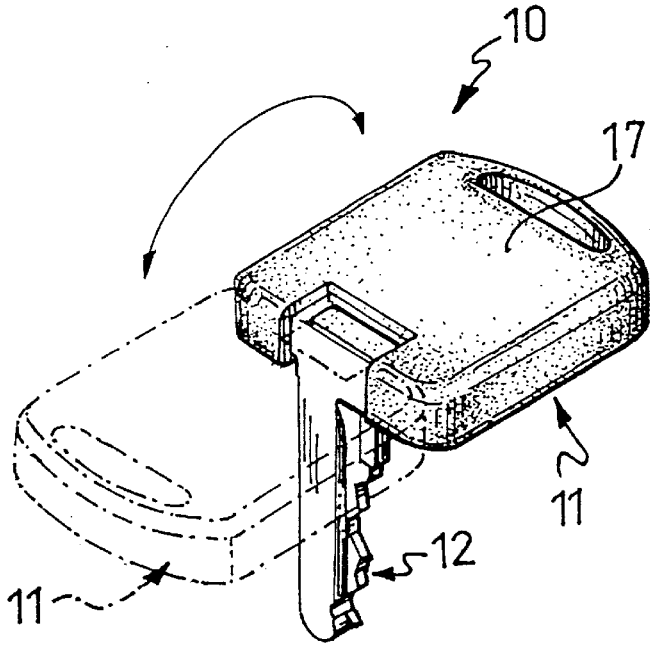
FIG. 2 shows the degree to which the bow of the key in FIG. 1 can bend with respect to the shank.
Figure 3:
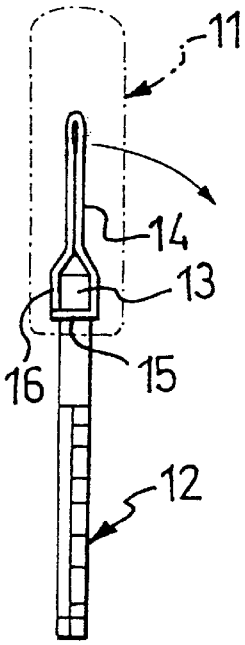
FIGS. 3, 4 and 5 show consecutive side views of the folding movement of the bow of the key in FIG. 1 with respect to the shank.
Figure 4:
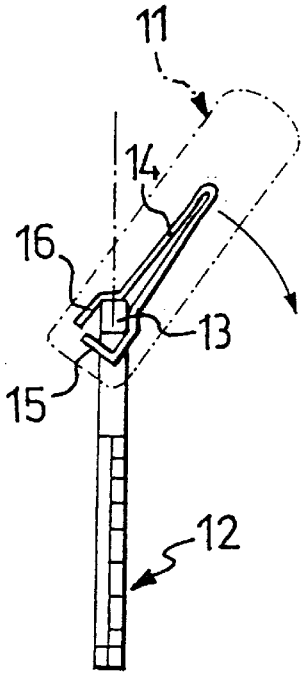
Figure 5:
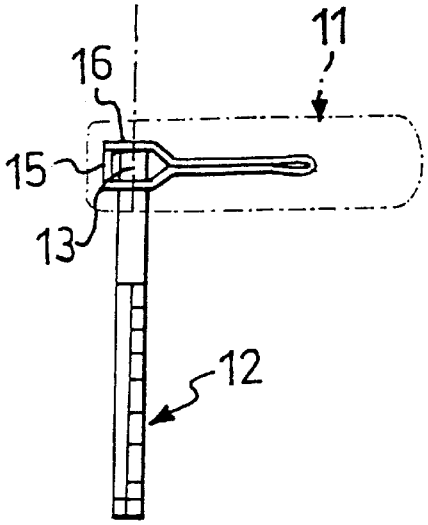
Figure 6:
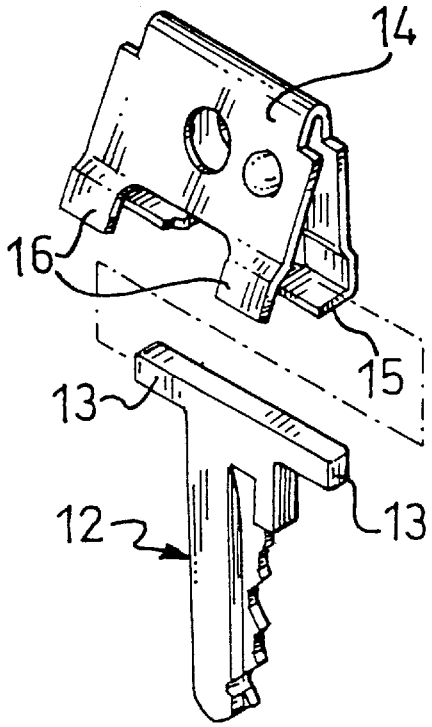
FIGS. 6, 7, 8 and 9 show perspective views of the stages involved in the assembly of the key in FIG. 1.
Figure 7:
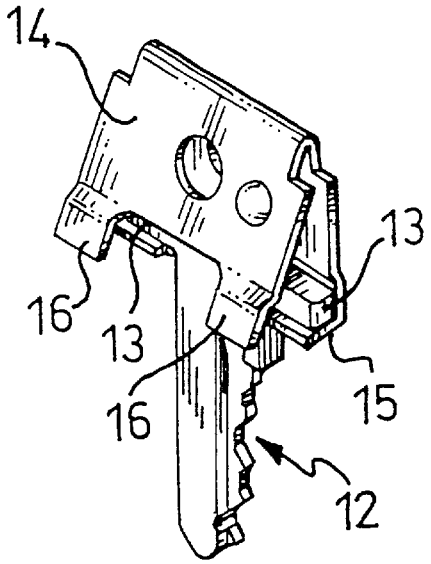
Figure 8:
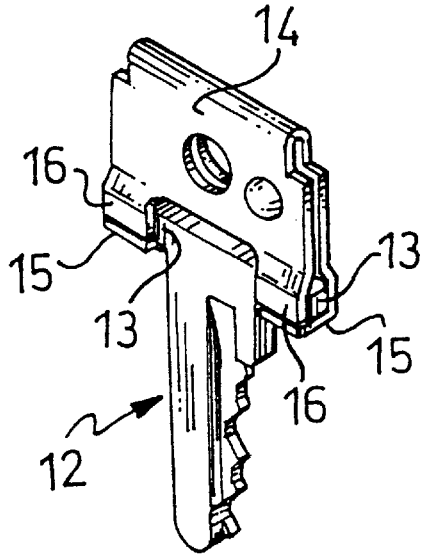
Figure 9:
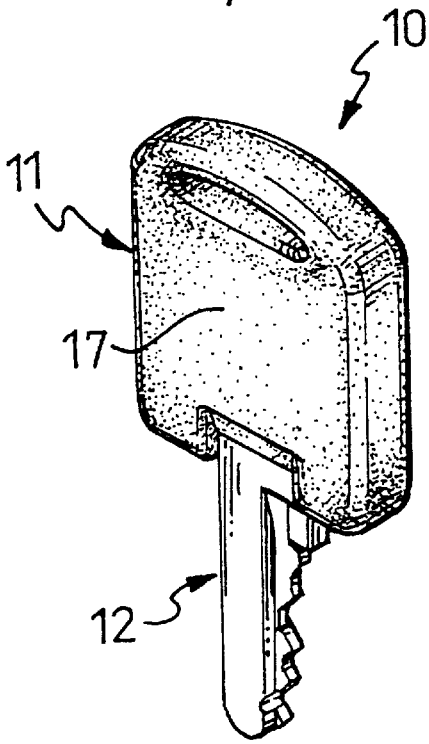

As shown in FIG. 2, the particular type of connection between the arms 13 of the shank 12 and the core 14 of the bow 11 allows the bow to bend through 90° in both directions with respect to the shank. More specifically, with reference to FIGS. 3, 4 and 5 which show the bow 11 folded at 90° in one direction, the core 14 rotates around the arms 13 and opens up slightly in order to get over the edges of the arms, elastically closing up again as soon as it has got past them; this opening up of the core is made possible by the elasticity of the casing 17. In this way, a snap-fastening connection is produced between the bow 11 and the arms 13 of the shank 12 which keeps the working position stable and enables the folded positions to be reached by overcoming a given force.

FIGS. 6, 7, 8 and 9 illustrate the sequence of stages in producing the key 10. As may be seen, the core 14 is firstly attached to the arms 13, the core is then pressed closed around the arms and, lastly, the casing 17 which encloses the core is moulded.

The key 10 is extremely inexpensive to produce because the operations described above can be carried out automatically using suitable machinery.

The casing made of soft elastic material is also particularly advantageous since, in conjunction with the ability of the bow to bend, it helps to minimize the effects of any knocks the bow may sustain. Furthermore, the softness of the bow prevents it from damaging parts of the structure to which the key and the corresponding lock may be attached; for example. if the key and the lock are applied to a door in a piece of furniture and the door is opened abruptly, this may cause the bow of the key to knock against part of the piece of furniture; however, because the casing is soft, the piece will not be damaged.

When the bow folds back as a result of its being knocked, the elasticity of the core allows the bow of the key to snap automatically into one of the two positions at 90° and for it to be held securely in this position. In other words, the key 10 has two stable, and therefore well-defined, folded positions. In contrast, in the known hinged keys with a pin and block discussed in the introduction, once the bow is moved out of the working position, it is free to rotate, even if in a limited way, about its pin, which therefore means that the folded positions are not stable.

Needless to say, variations and/or additions may be made to the embodiment described and illustrated.

The shape of the core and the cross-section of the arms may vary as long as they provide the snap-fastening connection referred to within the scope of this embodiment. For example, the cross-section of the arms and the corresponding shape of the ends of the core may have a polygonal shape other than a quadrilateral shape. The core may be made from any suitable material, not just metal. The casing, too, may be made from any soft material.

It would also be possible to envisage making the bow from a rigid, rather than soft, material, with suitable notches or equivalent provisions to make it yield elastically. It would also be possible to omit the core and make the bow from a rigid material, again with provisions to make it yield elastically, and additionally with suitable shaped portions, matching the shaped ends of the core, that are joined to the arms of the shank. In cases such as these, there is also the advantage of low production costs, however, the advantages that come with having a bow made of soft material are lost.

The arms could have a circular cross-section and the shaped ends of the core or the shaped portions of the bow could snap-fasten by means of projections and matching recesses formed in the arms and in the shaped ends or portions respectively.

The specific embodiment illustrated in the example referred to above has, however, proved to be particularly advantageous.

The hinged key described above may be used in any situation which requires a hinged bow.

What is claimed is:

1. A hinged lock key comprising a bow and a shank, in which the bow is hinged with respect to the shank and moves between a working position in which a longitudinal plane of the bow is substantially parallel to a longitudinal plane of the shank and a folded position in which the longitudinal plane of the bow is substantially perpendicular to the longitudinal plane of the shank, and in which a snap-fastening connection is provided which keeps the working position stable and enables the folded position to be reached when the shank is positioned in a lock by overcoming a given force, wherein two opposite transverse arms, on which the bow is hinged, extend from the shank and in that the snap-fastening connection acts between the bow and arms and wherein the bow includes a rigid core which is hinged on the arms and is embedded in an elastic casing to apply a resistive force against the rigid core during rotation of the shank relative to the bow.

2. The hinged lock key according to claim 1, in which the arms have a polygonal cross-section, the core consists of a folded piece of spring sheet metal with shaped ends that enclose the arms, following a shape of the arms, and the casing yields elastically, the connection between said shaped ends and the arms forming said snap-fastening connection, the piece of sheet metal opening and closing up again elastically as the piece of sheet metal rotates around the arms in order to get over the edges of the arms so as to enable the bow to snap elastically from the working position into a stable folded position and vice versa.

3. The hinged lock key according to claim 2, in which the cross-section of the arms is quadrilateral in order to allow the bow to bend through 90° in both directions with respect to the shank.

4. The hinged lock key according to claim 1, in which the core is made of metal and the casing is made of plastic.

5. The hinged lock key according to claim 4, in which the casing is made of silicone rubber.

6. A method for producing the key referred to in claim 1, in which the core is firstly attached to the arms, the core is then pressed closed around the arms and, lastly, the casing which encloses the core is molded.

7. A hinged lock key comprising:

a bow comprising a rigid core enclosed by an elastic casing and a shank for engaging a lock, the shank having two opposing transverse arms on which the bow is hinged to define a snap-fastening connection therebetween, wherein the bow is rotatably connected to the shank and rotates between a working position in which a longitudinal plane of the bow is at least substantially parallel to a longitudinal plane of the shank and a folded position in which the longitudinal plane of the bow is at least substantially normal to the longitudinal plane of the shank and wherein the shank and bow resist rotation when in the working and folded positions but are freely rotatable therebetween and wherein the elastic casing applies a resistive force against the rigid core during rotation of the shank relative to the bow.

8. The hinged lock key of claim 7, wherein the rigid core is composed of a different material than the elastic casing.

9. The hinged lock key of claim 8, wherein the rigid core is metal and the elastic casing is plastic.

10. The hinged lock key of claim 7, wherein the rigid core is a folded sheet having opposing and adjacent ends that receive the opposing arms of the shank.

11. A method for operating a hinged lock key, comprising:

rotating a bow that is snap fastened to a shank to a working position in which a longitudinal plane of the bow is at least substantially parallel to a longitudinal plane of the shank, the bow having a rigid core enclosed in an elastic casing to apply a resistive force against the rigid core during rotation of the shank relative to the bow;

locking the bow in the working position;

inserting the shank into a lock;

while the shank is in the lock, applying a force to the bow to unlock the bow from the working position and rotate the bow to a folded position in which the longitudinal plane of the shank is at least substantially normal to the longitudinal plane of the bow; and thereafter locking the bow in the folded position.

12. The method of claim 11, wherein in the locking step the core elastically yields outwardly when the bow is rotated about an arm of the shank to place the bow in the working position.

13. The method of claim 12, wherein the casing substantially completely encloses the core and thereby opposes the elastic yield of the core.

14. The method of claim 12, wherein the core has opposing members that are forced apart when the bow is moved from the working position to the folded position or vice versa.

15. The method of claim 11, wherein the core has opposing members that are separated by a first distance when in the working and folded positions and by a second distance when the bow is moved between the working and folded positions and the first distance is less than the second distance.

16. The hinged lock key of claim 7, wherein the core has opposing members that are separated by a first distance when in the working and folded positions and by a second distance when the bow is moved between the working and folded positions and the first distance is less than the second distance.

17. The hinged lock key of claim 1, wherein the core has opposing members that are separated by a first distance when in the working and folded positions land by a second distance when the bow is moved between the working and folded positions and the first distance is less than the second distance.

18. The hinged lock key of claim 1, wherein the core is substantially fully enclosed by the casing to resist deformation of the core in response to movement thereof between the working and folded positions.

19. The hinged lock key of claim 7, wherein the rigid core is substantially fully enclosed by the elastic casing to resist deformation of the core in response to movement thereof between the working and folded positions.

20. The method of claim 11, wherein the rigid core is substantially fully enclosed by the elastic casing to resist deformation of the core in response to movement thereof between the working and folded positions.

* * * * *

UNITED STATES PATENT AND TRADEMARK OFFICE

CERTIFICATE OF CORRECTION

PATENT NO. : 6,035,679
DATED : March 14, 2000
INVENTOR(S) : MERONI, Gersam

It is certified that error appears in the above-identified patent and that said Letters Patent is hereby corrected as shown below:

Title page, insert item [30] to read as follows:

Foreign Application Priority Data

| | | | |
|---|---|---|---|
| Apr. 23, 1997 | [EP] | Europe | 97830186.9 |

Signed and Sealed this

First Day of August, 2000

*Attest:*

*Attesting Officer*

Q. TODD DICKINSON

*Director of Patents and Trademarks*